US005418860A

United States Patent [19]

Daniels

[11] Patent Number: 5,418,860

[45] Date of Patent: May 23, 1995

[54] VOICE COIL EXCURSION AND AMPLITUDE GAIN CONTROL DEVICE

[75] Inventor: Drew Daniels, North Hills, Calif.

[73] Assignee: Aura Systems, Inc., El Segundo, Calif.

[21] Appl. No.: 62,807

[22] Filed: May 10, 1993

[51] Int. Cl.[6] ..... H04R 25/00

[52] U.S. Cl. ..... 381/194; 381/59; 381/96

[58] Field of Search ..... 381/194, 195, 96, 197, 381/192, 199, 59

[56] References Cited

U.S. PATENT DOCUMENTS

| | | | |
|---|---|---|---|
| 3,047,661 | 7/1962 | Winker | 381/96 |
| 4,598,178 | 7/1986 | Rollins | 381/158 |
| 4,607,382 | 8/1986 | Dijkstra et al. | 381/96 |
| 4,821,328 | 4/1989 | Drozdowski | 381/96 |

FOREIGN PATENT DOCUMENTS

| | | | |
|---|---|---|---|
| 3524280 | 1/1987 | Germany | 381/96 |
| 0157200 | 12/1981 | Japan | 381/194 |
| 0032198 | 2/1982 | Japan | 381/194 |
| 0093800 | 6/1982 | Japan | 381/194 |

*Primary Examiner*—Curtis Kuntz
*Assistant Examiner*—Huyen D. Le
*Attorney, Agent, or Firm*—Anthony T. Cascio; Lisa A. Merkadeau

[57] ABSTRACT

An active and passive loudspeaker voice coil excursion and amplitude gain control device is disclosed. The excursion and amplitude gain control device is utilized in connection with a voice coil actuator having a case, a coil and a coil carrier having an extreme downward position contacting the case. The excursion and amplitude gain control device includes a restraining member mounted to the coil carrier, wherein the restraining member is positioned on the carrier such that during downward movement of the coil carrier, the restraining member contacts the case before the coil carrier reaches the extreme downward position. A proximity sensor is mounted to the coil carrier, wherein the proximity sensor produces a proximity signal varying proportional to the distance of the sensor from the extreme downward position. When the proximity signal exceeds a threshold level, a feedback attenuation signal is fed to an electrical circuit that, in response to the proximity signal, sends an attenuation signal to the driving amplifier to limit the amplitude gain of the input signal. Limiting the amplitude gain of the input signal, in turn, limits the excursion of the voice coil and prevents the voice coil from reaching the extreme downward position.

8 Claims, 2 Drawing Sheets

VOICE COIL EXCURSION AND AMPLITUDE GAIN CONTROL DEVICE

FIELD OF THE INVENTION

The present invention relates generally to a device for preventing damage to a voice coil during excursion, and more particularly to a passive and an active device for control of amplitude gain and for preventing damage to the voice coil during excursion.

BACKGROUND OF THE INVENTION

It is known in the art of loudspeaker design to provide a speaker motor case to enclose a voice coil actuator for a loudspeaker. The voice coil is typically carried by a coil carrier. A small signal audio input is applied through an audio amplifier and a drive amplifier to produce a driving current for the loudspeaker. The input drive current is typically in a sinusoidal waveform. The driving current is applied to the voice coil, and pursuant to Lorenz's law, actuates the voice coil, causing voice coil excursion, or movement of the voice coil and carrier in an upward and downward axial direction.

One problem with the actuation of the voice coil arises when the input driving current exceeds a desired level. At this point, the amplified sinusoidal waveform, which serves as the driving current, is clipped at its peak amplitudes. The clipping in the input signal causes distortion in the output of the loudspeaker.

When the input driving current exceeds its desired level, the voice coil actuator also causes the coil carrier to move beyond its upper and lower position limits in the speaker motor case. The excursion of the voice coil carrier beyond these position limits in the speaker motor case can cause physical damage to or destruction of the voice coil.

Therefore, it is desirable to provide a device that actively controls the amplitude gain of the driving current input to the actuator. A need also exists for a device that actively prevents physical damage to the voice coil by controlling the amplitude of the voice coil excursion when damage to the voice coil is imminent. It is also desirable to provide a device that physically prevents the over-actuation and resultant physical damage of the voice coil.

SUMMARY OF THE INVENTION

Accordingly, it is a primary object of the present invention to overcome one or more disadvantages and limitations of the prior art.

A significant object of the present invention is to provide an active amplitude gain control device for the voice coil actuator of a loudspeaker.

Another significant object of the present invention is to provide a passive excursion control device for the voice coil of a loudspeaker that prevents the voice coil from reaching its extreme downward position within the case.

Yet another object of this invention is to provide an active excursion control device that provides a feedback signal to the input driving current of the voice coil actuator when the voice coil approaches the extreme downward position of the voice coil.

According to a broad aspect of the present invention, there is an improvement in a voice coil actuator having a case, a coil and a coil carrier, the coil carrier having an extreme downward position contacting the case. The improvement comprises a restraining member mounted to the coil carrier, wherein the restraining member is positioned on the carrier such that during downward movement of the coil carrier the restraining member contacts the case before the coil carrier reaches the extreme downward position. A proximity sensor is mounted to the coil carrier, wherein the proximity sensor produces a proximity signal that is processed by an electrical circuit to produce a feedback attenuation signal that varies in proportion to the distance of the sensor from the extreme downward position. The attenuation signal is applied to the driving amplifier to modify the input signal in response to the attenuation signal to control the amplitude gain of the input signal.

A feature of the present invention is that the excursion and amplitude gain control device prevents the voice coil from reaching the extreme downward position.

Another feature of the present invention is that the excursion and amplitude gain control device provides active amplitude gain control for the input signal to the actuator.

Yet another feature of the present invention is that the excursion and amplitude gain control device includes both active and passive voice coil protection and excursion control.

These and other objects, advantages and features of the present invention will become readily apparent to those skilled in the art from a study of the following description of an exemplary preferred embodiment when read in conjunction with the attached drawing and appended claims.

DESCRIPTION OF AN EXEMPLARY PREFERRED EMBODIMENT

Figure 1:
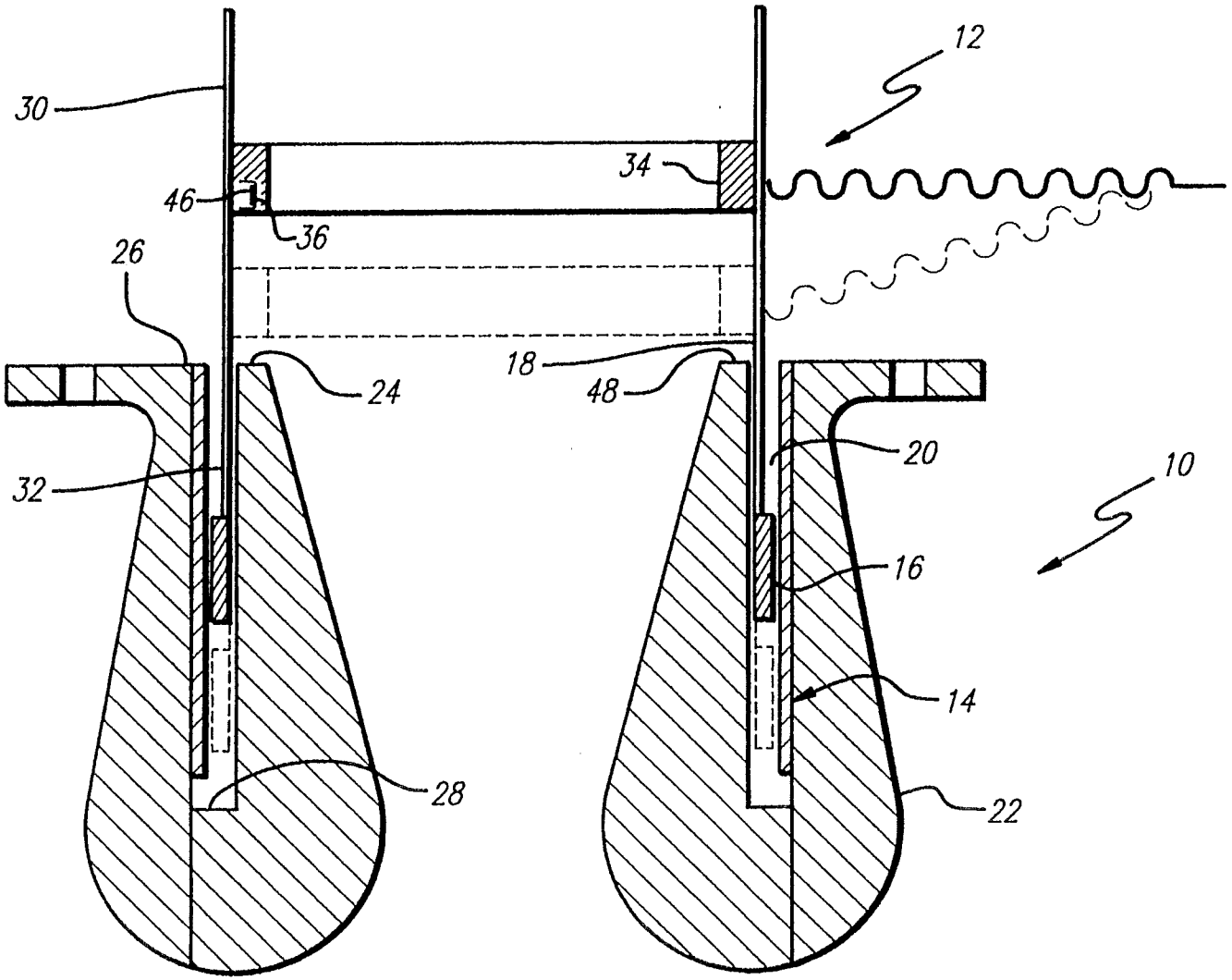
FIG. 1 is a cross-sectional view of the excursion and gain amplitude control device of the present invention.
Figure 2:
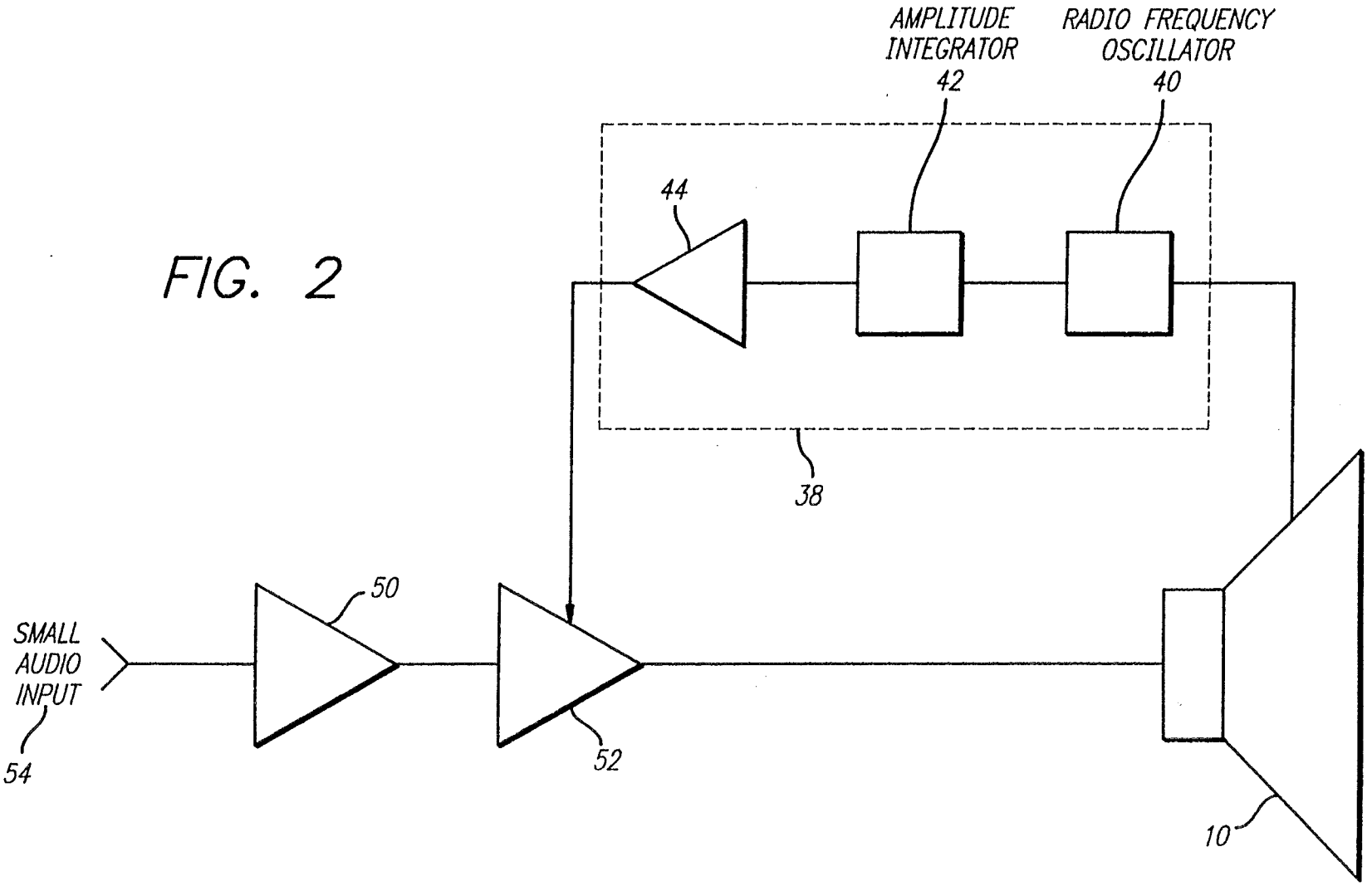
FIG. 2 is an electrical schematic of the excursion and gain amplitude control device of the present invention.

Referring now to FIG. 1, a loudspeaker 10 is shown having the excursion and amplitude gain control device 12 of the present invention. The loudspeaker 10 includes a voice coil actuator 14 having a voice coil 16. The voice coil 16 is wound around a voice coil carrier 18. In the loudspeaker shown in FIG. 1, the voice coil 16 and coil carrier 18 are disposed within a channel 20 in a speaker motor case 22. As previously described in the Background of the Invention, the driving current input, in the form of a sinusoidal waveform, actuates the voice coil 16, causing the excursion of the voice coil 16 and carrier 18 in an upward and downward axial direction. To produce the input driving current, a small audio signal 54 is passed through an audio amplifier 50 and a driving amplifier 52, as shown in FIG. 2.

The channel 20 of the speaker motor case 22 defines an inner upper edge 24, an outer upper edge 26, and a lower base 28. The voice coil carrier 18 is shown in FIG. 1 as a cylindrical member having an upper region 30 and a lower region 32. The voice coil 16 is wound around the outer circumference of the lower region 32 of the cylindrical member. The upper region 30 of the voice coil carrier 18 extends above the inner and outer upper edges 24, 26 of the channel 20 of the speaker motor case 22. During actuation of the voice coil 16, however, the voice coil 16 always remains within the walls of the channel 20.

The excursion and amplitude gain control device 12 of the present invention is designed to control the amplitude gain of the input signal to the actuator 14 and to prevent the excursion of the voice coil 16 and voice coil carrier 18 in a downward axial direction past the coil's lowest desired position. The coil's rest position and lowest desired position are represented in FIG. 1. As seen in FIG. 1, the excursion of the voice coil 16 and carrier 18 below the coil lowest position could cause the voice coil carrier 18 to contact the lower base 28 of the channel, thereby physically damaging the voice coil 16. For purposes of reference, the point at which the voice coil carrier contacts the lower base 28 of the case is referred to as the extreme downward position.

The excursion and gain control device 12 includes a restraining device 34, a proximity sensor 36 and an electrical circuit 38. In operation, the restraining device 34 acts a passive excursion control device and the proximity sensor 36 and electrical circuit 38 act as an active excursion and amplitude gain control device. Each of these devices are now described in detail.

The restraining device 34 serves to restrain active downward movement of the voice coil 16 and voice coil carrier 18 past the lowest desired position and prevent physical damage to the voice coil 16 and coil carrier 18. The restraining device 34 is preferably comprised of a ring-shaped member. The ring-shaped member is preferably mounted to a portion of the inner circumference of the upper region 30 of the voice coil carrier 18. In the embodiment shown, the inner upper edge 24 of the channel 20 serves as limiting member for the restraining device 34. As the voice coil 16 and voice coil carrier 18 move downward, the ring-shaped member will contact the inner upper edge 24 of the channel 20, thereby preventing the voice coil 16 and carrier 18 from downward travel below the coil lowest desired position to the extreme downward position.

The restraining device 34 may be used in conjunction with the active proximity sensor 36 and an electrical circuit 38. Alternatively, the proximity sensor 36 and electrical circuit 38 may be used alone. However, for exemplary purposes only, the proximity sensor 36 and electrical circuit 38 will be described herein as used in conjunction with the restraining device 34.

Referring now to FIGS. 1 and 2, the operation of the active proximity sensor 36 and electrical circuit 38 is described First referring to FIG. 2, the driving current of the loudspeaker is shown as produced by passing the small audio input 54 through the audio amplifier 50 and the driving amplifier 52. The driving current is in a sinusoidal waveform.

The proximity sensor 36 is mounted in the restraining device 34. Therefore, as the voice coil carrier 18 moves downward, the proximity sensor 36 becomes closer to the inner upper edge 24 of the channel 20 in the motor case 22. The proximity sensor 36 is associated with the electrical circuit 38 in order to provide the active feedback to the input driving current for the voice coil actuator 14.

The electrical circuit 38 may comprise the radio-frequency oscillator 40, the amplitude integrator 42, and the voltage-controlled amplifier 44. These components are arranged such that when a proximity signal from the proximity sensor 36 exceeds a pre-determined threshold level, a feedback attenuation signal is fed to the driving amplifier to cause it to limit the amplitude gain of the input signal to the actuator, thereby providing gain control. By limiting the amplitude gain of the input signal, clipping of the input driving signal is avoided. The avoidance of clipping in the input signal serves to eliminate distortion in the output of the speaker. Limiting the amplitude gain of the input signal also, in turn, limits the excursion of the voice coil and prevents the loudspeaker's moving assembly from reaching the extreme downward position.

In the embodiment of the invention shown in FIG. 1, an inductance coil 46 is used for the proximity sensor 38. The inner upper edge of the channel 24 of the case 22 provides an iron pole 48. Therefore, as the inductance coil 46 becomes closer to the iron pole 48, the electrical inductance increases proportional to the inverse square of the distance of the inductance coil 46 from the iron pole 48 or upper edge of the channel 24 in the case 22.

Alternatively, other types of proximity sensors may be used. For example, a Hall effect sensor may be utilized to provide the proximity signal to the electrical circuit.

There has been described hereinabove an exemplary preferred embodiment of the excursion control device according to the principles of the present invention. Those skilled in the art may now make numerous uses of, and departures from, the above-described embodiments without departing from the inventive concepts disclosed herein. For example, the speaker motor case and voice coil actuator design may vary. However, the excursion and gain control device of the present invention will operate effectively with other speaker motor case and voice coil actuator designs. Accordingly, the present invention is to be defined solely by the scope of the following claims.

I claim as my invention:

1. In a voice coil actuator having a case, a coil and a coil carrier, the coil carrier having an extreme downward position contacting the case, and the actuator being controlled by an input signal, an improvement comprising:

a proximity sensor mounted to the coil carrier, wherein said proximity sensor produces a proximity signal proportional to the distance of the sensor from the extreme downward position; and an amplitude gain control electrical circuit for processing the proximity signal and controlling the amplitude gain of the input signal in response to the proximity signal wherein said electrical circuit comprises a radio-frequency oscillator, an amplitude integrator, and a voltage-controlled amplifier.

2. An improvement in accordance with claim 1 wherein said proximity sensor is comprised of an inductance coil.

3. An improvement in accordance with claim 1 wherein said proximity sensor is mounted to a portion of an inner circumference of the coil carrier.

4. In a voice coil actuator having a case, a coil and a coil carrier, the coil carrier having an extreme downward position contacting the case, and the actuator being controlled by an input signal, an improvement comprising:

an upper surface of the case, the upper surface being an integral part of the case;

a restraining member mounted to the coil carrier, wherein said restraining member is positioned on the carrier such that during downward movement of the coil carrier, said restraining member contacts the upper surface of the case before the coil carrier reaches the extreme downward position;

a proximity sensor mounted to the coil carrier, wherein said proximity sensor produces a proximity signal varying proportional to the distance of the sensor from the extreme downward position; and an amplitude gain control electrical circuit for processing the proximity signal and controlling the amplitude gain of the input signal in response to the proximity signal, wherein said electrical circuit comprises a radio-frequency oscillator, an amplitude integrator, and a voltage-controlled amplifier.

5. An improvement in accordance with claim 4 wherein said proximity sensor is mounted within said restraining member.

6. An improvement in accordance with claim 4 wherein said restraining member is a ring-shaped member.

7. An improvement in accordance with claim 4 wherein said restraining member is mounted to a portion of an inner circumference of the coil carrier.

8. An improvement in accordance with claim 4 wherein said proximity sensor is comprised of an inductance coil.

* * * * *